US012060728B2

(12) United States Patent
Yao

(10) Patent No.: US 12,060,728 B2
(45) Date of Patent: Aug. 13, 2024

(54) MULTIFUNCTIONAL FRAME POOL

(71) Applicant: Jiangsu Comco Outdoor Products Co., Ltd., Huaian (CN)

(72) Inventor: Liang Yao, Huaian (CN)

(73) Assignee: Jiangsu Comco Outdoor Products Co., Ltd., Huai'an (CN)

( * ) Notice: Subject to any disclaimer, the term of this patent is extended or adjusted under 35 U.S.C. 154(b) by 126 days.

(21) Appl. No.: 18/085,627

(22) Filed: Dec. 21, 2022

(65) Prior Publication Data

US 2024/0209646 A1 Jun. 27, 2024

(51) Int. Cl.

| | |
|---|---|
| ***E04H 4/00*** | (2006.01) |
| ***E04H 4/10*** | (2006.01) |
| ***E04H 4/14*** | (2006.01) |
| ***E04H 15/02*** | (2006.01) |

(52) U.S. Cl.

CPC ..... *E04H 4/0056* (2013.01); *E04H 4/108* (2013.01); *E04H 4/144* (2013.01); *E04H 15/02* (2013.01)

(58) Field of Classification Search

CPC ..... E04H 4/0056; E04H 4/108; E04H 4/144; E04H 15/02; E04H 15/04

USPC ..... 4/498, 503, 513

See application file for complete search history.

(56) References Cited

U.S. PATENT DOCUMENTS

| | | | | |
|---|---|---|---|---|
| 3,469,587 | A * | 9/1969 | Folkes | E04H 15/02 4/498 |
| 5,706,531 | A * | 1/1998 | Aubertine | E04H 4/108 4/498 |
| 11,149,454 | B1 * | 10/2021 | Andrews | E04H 4/108 |
| 2005/0108817 | A1 * | 5/2005 | Wilson | E04H 4/108 4/498 |
| 2008/0244820 | A1 * | 10/2008 | Moore | E04H 4/108 4/498 |
| 2009/0307834 | A1 * | 12/2009 | Rizzotto | E04H 4/108 4/503 |

FOREIGN PATENT DOCUMENTS

| | | | |
|---|---|---|---|
| CN | 111425028 | A | 7/2020 |
| CN | 216787934 | U * | 6/2022 |

* cited by examiner

*Primary Examiner* — Tuan N Nguyen
(74) *Attorney, Agent, or Firm* — Bayramoglu Law Offices LLC

(57) ABSTRACT

A multifunctional frame pool includes a foldable water inner container; a frame assembly arranged at a periphery of the water inner container and configured to support the water inner container; a platform arranged on an upper edge of the water inner container; and a tent including tent cloth and tent frames. The tent cloth is arranged above the water inner container via the tent frames. Each of the tent frames has a bottom end arranged on the frame assembly or platform, and a top end in contact with the tent cloth. At least two tow assemblies are arranged on the tent cloth. Each of the tow assemblies has one end connected to the tent cloth, and the other end that is movable to change an angle formed by the tent cloth between a tow point and the corresponding tent frame, and the ground.

18 Claims, 2 Drawing Sheets

MULTIFUNCTIONAL FRAME POOL

TECHNICAL FIELD

The present disclosure relates to the technical field of swimming pools, in particular to a multifunctional frame pool.

BACKGROUND

Swimming, as a favorite sport for most people, may improve the function of people's heart and lungs, and promote the increase of vital capacity and the burning of fat, and is conducive to muscle growth and fat reduction. To expand applicable scenes of swimming pools, frame pools emerge. The frame pools are widely popular because of convenient arrangement, safe use, cleanliness and sanitation, no need for special venues, etc.

At present, a frame pool, such as a mobile drowning-free pool provided in CN111425028A, includes a mobile inclined bottom water tank, liftable grate bottom steps, a water purification system, a mobile diving platform, and a sunshade. The applicant believes that at present, sunshades that can function during use of frame pools on the market are mostly supported by support rods arranged at the peripheries of the pools, as disclosed in the above patent. However, the sunshade angle of a sunshade of such a pool cannot be changed, and the flat-roof sunshade cannot protect against rain and wind. Therefore, it is necessary to provide a frame pool capable of adjusting the sunshade angle.

SUMMARY

To overcome the defects in the prior art, an objective of the present disclosure is to provide a multifunctional frame pool, so as to solve the problems mentioned in the above background.

To achieve the above objective, the present disclosure adopts the following technical solution:

A multifunctional frame pool, including:

a foldable water inner container;

a frame assembly arranged at a periphery of the water inner container and configured to support the water inner container;

a platform arranged on an upper edge of the water inner container; and a tent including tent cloth and tent frames, where the tent cloth is arranged above the water inner container via the tent frames;

each of the tent frames has a bottom end arranged on the frame assembly or platform, and a top end in contact with the tent cloth: and at least two tow assemblies are arranged on the tent cloth, and each of the tow assemblies has one end connected to the tent cloth, and the other end that is movable to change an angle formed by the tent cloth between a tow point and the corresponding tent frame, and the ground.

Through the arranged tent, the tent cloth may be arranged at different positions of the water inner container along with movement of the tent frames. A position of the tent cloth is adjusted by the tow assemblies to block sunlight in different directions. Even if the pool is not moved, a very good sunshade effect can also be taken to prevent a user from being suntanned or sunburned when swimming.

Further, the frame assembly includes transverse rods and V-shaped inclined supports: the transverse rods are arranged along a circumferential direction of the upper edge of the water inner container, and are configured to maintain a shape of the upper edge of the water inner container; and each of the V-shaped inclined supports has one end connected to the corresponding transverse rod, and the other end supporting the ground, and is configured to maintain a height of the water inner container.

Through the arranged V-shaped inclined supports, the transverse rods are supported in a wider range, which effectively reduces the number of components required for the frame assembly, reduces the weight of the frame assembly, and lowers the complexity of mounting and disassembly.

Furthermore, the frame assembly includes L-shaped tubes, and the two adjacent transverse rods are connected to each other via the corresponding L-shaped tube, such that the transverse rods are connected via the L-shaped tubes to form a closed frame.

Furthermore, the multifunctional frame pool includes the platform arranged on an upper part of the water inner container, and the platform includes platform rods, platform membrane cloth, and platform rod sleeves: and the platform rods are mounted on the L-shaped tubes, an inner edge of the platform membrane cloth is mounted on the upper part of the water inner container by means of butt fusion, the plurality of platform rod sleeves are mounted on an outer edge of the platform membrane cloth by means of butt fusion, and the platform membrane cloth is fixedly mounted on the platform rods via the platform rod sleeves.

The platform surrounds the upper part of the water inner container, may be configured to place mobile phones, swim rings, and other items, and may also enable the user to lie thereon for proper rest.

Furthermore, the multifunctional frame pool includes a ladder, the ladder includes support tubes and pedals, and the pedals are mounted between the two support tubes: and the support tubes are mounted on the transverse rods.

The pedals on the ladder may be disassembled freely. When not in use, the pedals may be taken down to prevent children from entering the pool by mistake to cause danger. The ladder and the transverse rods in the frame assembly are fixed together, which effectively avoids side turnover of a conventional ladder due to insufficient weight. After a lower part of the ladder is connected to fixing sleeves of the pool, the ladder is more stable, and one side of the pool is supported, which enhances the stability of the pool, and may reduce the number of V-shaped supports, thus reducing the support cost.

Furthermore, the ladder includes ladder four-way units, the support tubes are mounted on the transverse rods via the ladder four-way units, and an angle between adjacent connectors of each of the ladder four-way units is 90°.

Furthermore, the pedals are detachably mounted between the two support tubes.

Furthermore, each of the V-shaped inclined supports includes two inclined support rods, the two inclined support rods are connected to each other such that the corresponding V-shaped inclined support includes an opening portion and a connecting portion, and the opening portion is connected to the corresponding transverse rod; and the fixing sleeves are arranged on side walls of the water inner container along a circumferential direction of a bottom, the connecting portion of the two inclined support rods is connected after passing through the corresponding fixing sleeve, and the connecting portion is connected to the water inner container via the corresponding fixing sleeve.

Further, fixing holes are arranged on the tent cloth, each of the tow assemblies includes a fixing rope, and the fixing rope has one end connected to the corresponding fixing hole, and the other end fixed to the ground.

Furthermore, the water inner container is made of a soft material, such that the water inner container may be folded for storage to reduce the occupied area.

Compared to the prior art, the present disclosure has the following beneficial effects:

The tent of this pool may be fixed by the two or more tent frames, and may be fixed to different positions. Compared to a conventional flat-roof and immovable pool sunshade, this pool makes the angle of the tent cloth adjustable by adjusting positions of the fixing ropes and the tent frames, and therefore can block sunlight in different irradiation directions. In addition, the tent cloth, when directly fixed to transverse rods of the frame assembly, may serve as a pool cover to prevent rainwater or dirt from entering the pool.

BRIEF DESCRIPTION OF THE DRAWINGS

To more clearly illustrate the technical solution in the embodiments of the present disclosure, the accompanying drawings that need to be used in the description of the embodiments will be briefly introduced below. Apparently, the accompanying drawings in the description below merely illustrate some embodiments of the present disclosure. Those of ordinary skill in the art may also derive other accompanying drawings from these accompanying drawings without creative efforts.

In figures, reference numerals are as follows.

1: water inner container; 2: frame assembly; 201: transverse rod; 202: L-shaped tube; 203: V-shaped inclined support; 3: tent; 301: tent cloth; 3011: fixing hole; 302: tent frame; 4: fixing rope; 5: platform; 501: platform rod; 502: platform membrane cloth; 503: platform rod sleeve; 6: ladder; 601: support tube; 602: ladder four-way unit; 603: pedal; and 7: fixing sleeve.

DETAILED DESCRIPTION OF THE EMBODIMENTS

To more clearly describe the present disclosure, the present disclosure is further described in detail below in conjunction with the embodiment and with reference to the accompanying drawings. Those skilled in the art should understand that the content specifically described below is illustrative rather than restrictive, and should not limit the scope of protection of the present disclosure.

In the description of the present disclosure, it should be noted that the orientational or positional relationships indicated by the terms "inside", "outside", "above", "below", etc. are the orientational or positional relationships shown in the accompanying drawings, which are merely for the convenience of describing the present disclosure and simplifying the description, rather than indicating or implying that the referred apparatus or element must have a particular orientation or be constructed and operated in a particular orientation. Therefore, they should not be understood as limiting the present disclosure. In addition, the terms "mounting", "connection", etc. should be understood in a broad sense, unless otherwise specified and defined. For example, the connection may be fixed connection, detachable connection, or integrated connection; moreover, the connection may be mechanical connection or electrical connection: and besides, the connection may be direct connection, indirect connection via an intermediate medium, or communication between interiors of two elements. Those of ordinary skill in the art may understand specific meanings of the above terms in the present disclosure according to specific circumstances.

Embodiment

Figure 1:
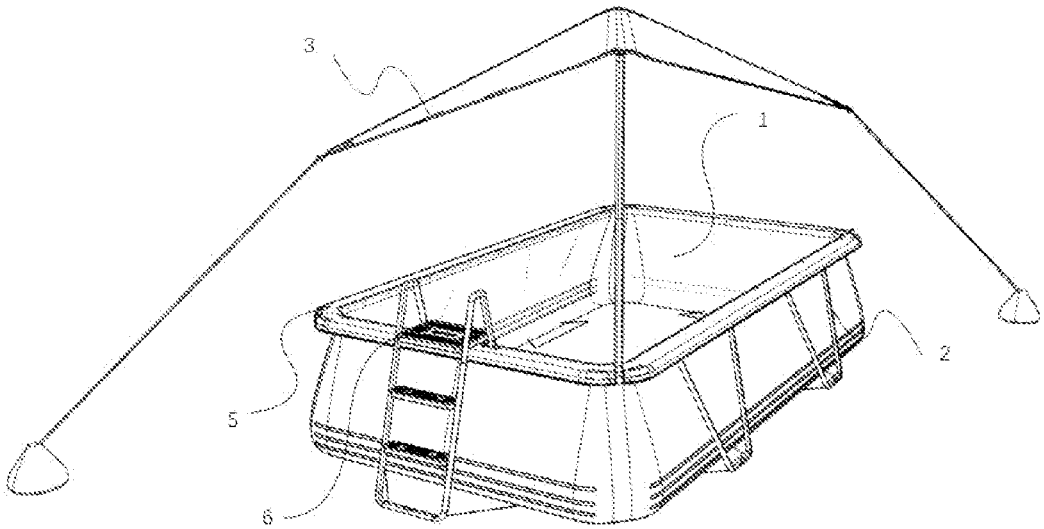
FIG. 1 is a schematic diagram of an overall structure of an embodiment of the present disclosure.
Figure 2:
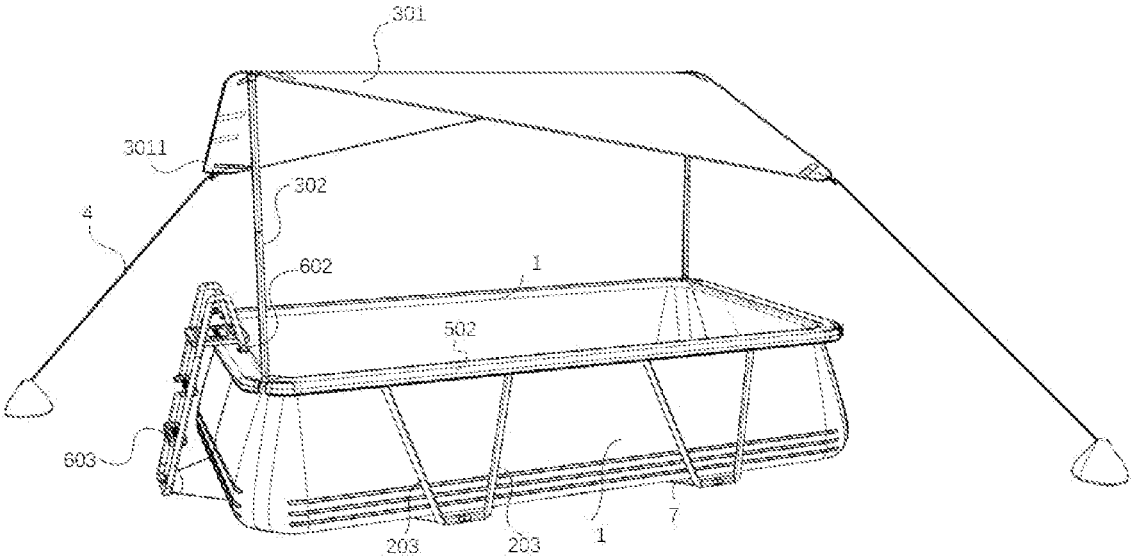
FIG. 2 is an another schematic diagram of the overall structure of the embodiment of the present disclosure.
Figure 3:
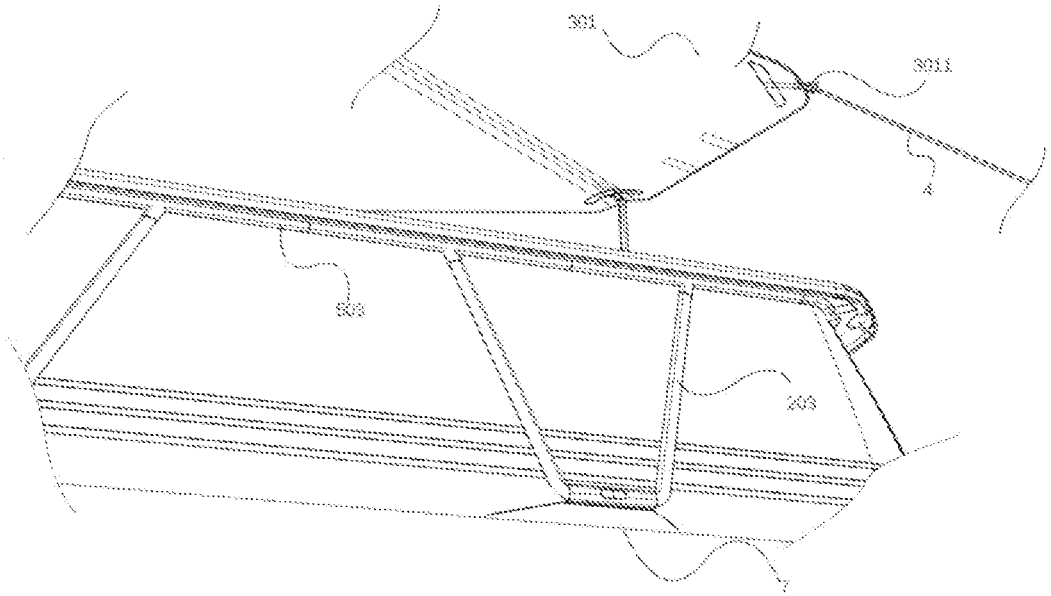
FIG. 3 is an another schematic structural diagram of a ladder in the embodiment of the present disclosure.
Figure 4:
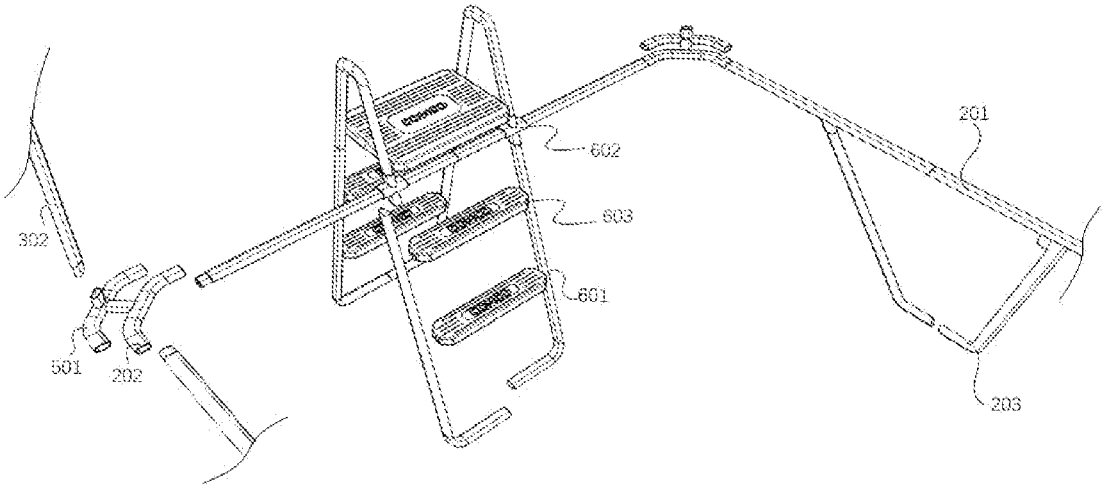
FIG. 4 is an another schematic structural diagram of a V-shaped inclined support in the embodiment of the present disclosure.

A multifunctional frame pool, as shown in FIGS. 1 to 4, includes a water inner container 1, a frame assembly 2, a tent 3, and a platform 5. The water inner container 1 is foldable, and specifically it may be made of a soft material, such that when not in use, the water inner container 1 may be folded for storage to reduce the occupied area. The frame assembly 2 is arranged at a periphery of the water inner container 1, and is configured to support the water inner container 1. The tent is arranged above the water inner container 1, and is configured to keep out the sun or rain. The platform 5 surrounds an upper part of the water inner container 1, may be configured to place mobile phones, swim rings, and other items, and may also enable a user to lie on the platform 5 for proper rest.

The frame assembly 2 includes transverse rods 201, L-shaped tubes 202, and V-shaped inclined supports 203. The transverse rods 201 are arranged along a circumferential direction of an upper edge of the water inner container 1, and are configured to maintain a shape of the upper edge of the water inner container 1. The two adjacent transverse rods 201 are connected to each other via the corresponding L-shaped tube 202, such that the transverse rods are connected via the L-shaped tubes to form a closed frame. Each of the V-shaped inclined supports 203 has one end connected to the corresponding transverse rod 201, and the other end configured to support the ground, so as to maintain a height of the water inner container 1. Through the arranged V-shaped inclined supports 203, the transverse rods 201 are supported in a wider range, which effectively reduces the number of components required for the frame assembly 2, reduces the weight of the frame assembly 2, and lowers the complexity of mounting and disassembly.

Fixing sleeves 7 are arranged on side walls of the water inner container 1 along a circumferential direction of a bottom, and the fixing sleeves 7 are configured to limit positions of the V-shaped inclined supports 203. Each of the V-shaped inclined supports 203 includes two inclined support rods, and one ends of the two inclined support rods are connected to each other at a certain angle, such that the corresponding V-shaped inclined support 203 is formed with an opening portion and a connecting portion, where the opening portion is connected to the corresponding transverse rod 201. The connecting portion of the two inclined support rods is connected after passing through the corresponding fixing sleeve 7, and the connecting portion is connected to the water inner container 1 via the corresponding fixing sleeve 7.

The platform 5 is arranged on the upper part of the water inner container 1, and the platform 5 includes platform rods 501, platform membrane cloth 502, and platform rod sleeves 503. The platform rods 501 are mounted on the L-shaped tubes 202, an inner edge of the platform membrane cloth 502 is mounted on the upper part of the water inner container 1 by means of butt fusion, the plurality of platform rod sleeves 503 are mounted on an outer edge of the platform membrane cloth 502 by means of butt fusion, and the platform membrane cloth 502 is fixedly mounted on the platform rods 501 via the platform rod sleeves 503.

The tent 3 includes tent cloth 301 and tent frames 302, and the tent cloth 301 is arranged above the water inner container 1 via the tent frames 302. Bottom ends of the tent frames 302 are arranged on the frame assembly 2 or platform 5. Specifically, the tent frames 302 are arranged on the transverse rods 201, the L-shaped tubes 202, or the platform rods 501. Top ends of the tent frames 302 are in contact with the tent cloth 301, and jack up the tent cloth 301. At least two tow assemblies are arranged on the tent cloth 301. Each of the tow assemblies has one end connected to the tent cloth 301, and the other end that is movable to change an angle formed by the tent cloth 301 between a tow point and the corresponding tent frame 302, and the ground. Cloth sleeves may be arranged at positions of contact between the tent cloth 301 and the tent frames 302 to limit positions of the tent frames 302, so as to prevent slip when the angle of the tent cloth 301 is changed.

The positions of the tent frames 302 may be changed according to environments, and a position of the tent cloth 301 is adjusted by the tow assemblies to block sunlight in different directions. Even if the pool is not moved, a very good sunshade effect can also be taken to prevent the user from being suntanned or sunburned when swimming.

In this embodiment, fixing holes 3011 are arranged on the tent cloth 301, each of the tow assemblies is a fixing rope 4, and the fixing rope 4 has one end tied in the corresponding fixing hole 3011, and the other end that may be fixed to the ground via stakes and etc.

To bring convenience for the user to go in or out, a ladder 6 is further arranged on the water inner container 1. The ladder 6 includes support tubes 601, ladder four-way units 602, and pedals 603, the support tubes 601 are mounted on the transverse rods 201 via the ladder four-way units 602, and an angle between adjacent connectors of each of the ladder four-way units 602 is 90°, such that a stress is concentrated. The pedals 603 are detachably mounted between the two support tubes 601. Specifically, the pedals are connected via one L-shaped support. Mounting holes are arranged on the support tubes 601 according to a height of the pedals 603. The L-shaped support has one side limited in the mounting holes, and the other side configured to bear the pedals 603. The ladder 6 may also be fixed to the water inner container 1 via the cloth sleeves, and bottoms of the support tubes 601 pass through the cloth sleeves to make the ladder 6 limited in the water inner container 1.

The pedals 603 on the ladder may be disassembled freely. When not in use, the pedals 603 may be taken down to prevent children from entering the pool by mistake to cause danger. In view of usage environments, anti-slip lines are arranged on surfaces of the pedals 603. The ladder 6 and the transverse rods 201 in the frame assembly 2 are fixed together, which effectively avoids side turnover of a conventional ladder due to insufficient weight. A lower part of the ladder 6 may be connected to the water inner container 1 by arranging the cloth sleeves, such that the ladder 6 is more stable, and one side of the water inner container 1 is supported, which enhances the stability of the pool, and may reduce the number of V-shaped supports 203, thus reducing the production cost.

Apparently, the above embodiment of the present disclosure is only an example to more clearly describe the present disclosure, rather than to limit the implementation of the present disclosure. Those of ordinary skill in the art may also make other changes or variations in different forms on the basis of the above description. It is impossible to enumerate all implementation methods here. Any apparent changes or variations arising from the technical solution of the present disclosure still fall within the scope of protection of the present disclosure.

What is claimed is:

1. A multifunctional frame pool, comprising:

a foldable water inner container;

a frame assembly arranged at a periphery of the water inner container and configured to support the water inner container;

a platform arranged on an upper edge of the water inner container; and a tent comprising a tent cloth and tent frames, wherein the tent cloth is arranged above the water inner container via the tent frames;

each of the tent frames has a bottom end arranged on the frame assembly or the platform, and a top end in contact with the tent cloth; and at least two tow assemblies are arranged on the tent cloth, and each of the at least two tow assemblies has a first end connected to the tent cloth, and a second end, wherein the second end is movable to change an angle formed by the tent cloth between a tow point and the tent frame, and the ground.

2. The multifunctional frame pool according to claim 1, wherein the frame assembly comprises transverse rods and V-shaped inclined supports; the transverse rods are arranged along a circumferential direction of the upper edge of the water inner container, and are configured to maintain a shape of the upper edge of the water inner container; and each of the V-shaped inclined supports has a first end connected to the transverse rod corresponding to the first end, and a second end supporting the ground, and is configured to maintain a height of the water inner container.

3. The multifunctional frame pool according to claim 2, wherein the frame assembly further comprises L-shaped tubes, and two adjacent transverse rods are connected to each other via the L-shaped tube corresponding to the two adjacent transverse rods.

4. The multifunctional frame pool according to claim 3, wherein the platform comprises platform rods, a platform membrane cloth, and platform rod sleeves; and the platform rods are mounted on the L-shaped tubes, an inner edge of the platform membrane cloth is mounted on an upper part of the water inner container by means of butt fusion, the plurality of platform rod sleeves are mounted on an outer edge of the platform membrane cloth by means of butt fusion, and the platform membrane cloth is fixedly mounted on the platform rods via the platform rod sleeves.

5. The multifunctional frame pool according to claim 4, wherein the water inner container is made of a soft material.

6. The multifunctional frame pool according to claim 3, wherein the water inner container is made of a soft material.

7. The multifunctional frame pool according to claim 2, further comprising a ladder, wherein the ladder comprises support tubes and pedals, and the pedals are mounted between two support tubes; and the support tubes are mounted on the transverse rods.

8. The multifunctional frame pool according to claim 7, wherein the ladder further comprises ladder four-way units, the support tubes are mounted on the transverse rods via the ladder four-way units, and an angle between adjacent connectors of each of the ladder four-way units is 90°.

9. The multifunctional frame pool according to claim 8, wherein the water inner container is made of a soft material.

10. The multifunctional frame pool according to claim 7, wherein the pedals are detachably mounted between the two support tubes.

11. The multifunctional frame pool according to claim 10, wherein the water inner container is made of a soft material.

12. The multifunctional frame pool according to claim 7, wherein the water inner container is made of a soft material.

13. The multifunctional frame pool according to claim 2, wherein each of the V-shaped inclined supports comprises two inclined support rods, the two inclined support rods are connected to each other, wherein the V-shaped inclined support comprises an opening portion and a connecting portion, and the opening portion is connected to the transverse rod; and fixing sleeves are arranged on side walls of the water inner container along a circumferential direction of a bottom, the connecting portions of the two inclined support rods is connected after passing through the fixing sleeve, and the connecting portion is connected to the water inner container via the fixing sleeve.

14. The multifunctional frame pool according to claim 13, wherein the water inner container is made of a soft material.

15. The multifunctional frame pool according to claim 2, wherein the water inner container is made of a soft material.

16. The multifunctional frame pool according to claim 1, wherein fixing holes are arranged on the tent cloth, each of the at least two tow assemblies comprises a fixing rope, and the fixing rope has a first end connected to the fixing hole corresponding to the first end, and a second end fixed to the ground.

17. The multifunctional frame pool according to claim 16, wherein the water inner container is made of a soft material.

18. The multifunctional frame pool according to claim 1, wherein the water inner container is made of a soft material.

* * * * *